US009937379B2

(12) United States Patent
Mortensen et al.

(10) Patent No.: US 9,937,379 B2
(45) **Date of Patent: *Apr. 10, 2018**

(54) FOLDING ELLIPTICAL LIFT ASSIST SYSTEM

(71) Applicant: ICON Health & Fitness, Inc., Logan, UT (US)

(72) Inventors: Nathan Mortensen, Montpelier, ID (US); William T. Dalebout, North Logan, UT (US); Trenton Von Larsen, Hyrum, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/202,352

(22) Filed: Jul. 5, 2016

(65) Prior Publication Data

US 2016/0310787 A1 Oct. 27, 2016

Related U.S. Application Data

(63) Continuation of application No. 14/303,451, filed on Jun. 12, 2014, now Pat. No. 9,381,394.

(Continued)

(51) Int. Cl.
*A63B 22/04* (2006.01)
*A63B 22/06* (2006.01)

(Continued)

(52) U.S. Cl.
CPC ..... *A63B 22/0664* (2013.01); *A63B 22/0002* (2013.01); *A63B 22/0012* (2013.01);

(Continued)

(58) Field of Classification Search
CPC . A63B 22/0664; A63B 22/02; A63B 22/0002; A63B 22/0012; A63B 71/0619;

(Continued)

(56) References Cited

U.S. PATENT DOCUMENTS 5,746,683 A 5/1998 Lee
5,755,643 A 5/1998 Sands (Continued)

FOREIGN PATENT DOCUMENTS

| | | |
|---|---|---|
| CN | 201815049 | 5/2011 |
| WO | 9958204 | 11/1999 |
| WO | 2008138124 | 11/2008 |

OTHER PUBLICATIONS

International Search Report issued for PCT/US2014/042179 dated Oct. 10, 2014.

*Primary Examiner* — Loan H Thanh
*Assistant Examiner* — Megan Anderson
(74) *Attorney, Agent, or Firm* — Holland & Hart LLP

(57) ABSTRACT

An elliptical exercise machine, in one embodiment, includes a first assembly pivotally coupled with a second assembly and at least one assist mechanism. The first assembly includes a first frame member, a rotational resistance mechanism associated with the first frame member, a first foot support member pivotally coupled to a portion of the rotational mechanism and a second foot support member pivotally coupled to another portion of the rotational mechanism. The second assembly includes a second frame member, a first reciprocating arm pivotally coupled with the second frame member, a second reciprocating arm pivotally coupled with the second frame member. In one embodiment, the assist mechanism may include a folding assist mechanism to provide resistance between the assemblies during a folding transition. In another embodiment, the assist mechanism may include a rotational assist mechanism to assist a user in transitioning the elliptical machine to an upright storage position.

20 Claims, 16 Drawing Sheets

Related U.S. Application Data

(60) Provisional application No. 61/834,711, filed on Jun. 13, 2013.

(51) Int. Cl.
*A63B 71/06* (2006.01)
*A63B 22/00* (2006.01)
*A63B 71/02* (2006.01)

(52) U.S. Cl.
CPC ..... *A63B 22/04* (2013.01); *A63B 71/0619* (2013.01); *A63B 2022/067* (2013.01); *A63B 2071/025* (2013.01); *A63B 2071/063* (2013.01); *A63B 2071/0625* (2013.01); *A63B 2210/50* (2013.01); *A63B 2225/093* (2013.01)

(58) Field of Classification Search
CPC ..... A63B 2022/067; A63B 2071/025; A63B 2071/0625; A63B 2071/063; A63B 2225/093
See application file for complete search history.

(56) References Cited

U.S. PATENT DOCUMENTS

| | | | | |
|---|---|---|---|---|
| 5,782,722 | A | 7/1998 | Sands | |
| 5,860,895 | A | 1/1999 | Lee | |
| 6,190,289 | B1 | 2/2001 | Pyles et al. | |
| 7,775,940 | B2 | 8/2010 | Dalebout et al. | |
| 7,946,962 | B2 | 5/2011 | Long | |
| 8,663,070 | B2 | 3/2014 | Long | |
| 2009/0124465 | A1 | 5/2009 | Wang | |
| 2010/0167880 | A1 | 7/2010 | Long et al. | |
| 2010/0242246 | A1 | 9/2010 | Dalebout | |
| 2012/0088638 | A1 | 4/2012 | Lull | |
| 2013/0237383 | A1* | 9/2013 | Chen ..... | A63B 22/02 482/54 |
| 2014/0073488 | A1 | 3/2014 | Wu | |
| 2014/0371034 | A1 | 12/2014 | Mortensen | |
| 2014/0371035 | A1 | 12/2014 | Mortensen | |
| 2015/0182787 | A1 | 7/2015 | Liu | |

* cited by examiner

FOLDING ELLIPTICAL LIFT ASSIST SYSTEM

CROSS-REFERENCE TO RELATED APPLICATIONS

This application is a continuation of U.S. application Ser. No. 14/303,451, filed on Jun. 12, 2014, which claims priority to U.S. Provisional Patent Application No. 61/834,711 filed on Jun. 13, 2013 and is related to U.S. Provisional Patent Application No. 61/834,709 filed on Jun. 13, 2013 and U.S. Provisional Patent Application No. 61/834,706 filed on Jun. 13, 2013.

TECHNICAL FIELD

The present disclosure relates to exercise equipment. More particularly, the present disclosure relates to elliptical type exercise devices that include a folding mechanism and stabilization features.

BACKGROUND

There are many types of exercise machines available for individuals to utilize in maintaining physical fitness. Many people have obtained exercise machines for their home so that they can exercise at their convenience without having to travel to a gym or other remote location. Home exercise equipment may include, for example, free weights, weight stacks, resistance weights, treadmills, stationary bicycles and elliptical machines.

While each type of equipment provides certain benefits, elliptical machines are popular with many individuals because they are considered to be a non-impact exercise which is easy on the joints of an individual. Generally speaking, conventional elliptical machines include alternating reciprocating foot supports configured to traverse or travel about a closed path to simulate a striding, running, walking, and/or a climbing motion for the individual using the machine. Each reciprocating foot support conventionally has one end supported for rotational motion about a pivot point, with the other end supported in a manner configured to cause the reciprocating foot support to travel or traverse a closed path, such as a reciprocating elliptical or oblong path or other similar geometric outline. During operation of the elliptical machine, each reciprocating foot support is caused to travel or traverse the closed path, thereby simulating a striding motion of the user for exercise purposes. The reciprocating foot supports are conventionally configured to be out of phase with one another by 180° in order to simulate a proper and natural alternating stride motion.

An individual may utilize an elliptical exercise machine by placing his or her feet onto the reciprocating foot supports and actuating the exercise machine to cause the reciprocating foot supports to repeatedly travel their respective closed paths. This action effectively results in a series of strides achieved by the individual to obtain exercise, with a low-impact advantage. An elliptical exercise machine may further include mechanisms or systems for increasing the resistance of the motion. In addition, the reciprocating motion of the feet to achieve a series of strides may be complemented by a reciprocating movement of the arms, whether assisted by the exercise machine via a suitably configured mechanism or system, or unassisted.

Elliptical machines may be configured as a "front mechanism" or a "rear mechanism" type machine. Such a designation indicates where the rotating mechanism (typically a flywheel) attached to the foot supports is located—i.e., at the front of the machine or at the rear of the machine. The location of the rotating mechanism typically has an impact on the path of the foot supports. For example, a front mechanism is often considered to produce a longer, flatter stride, while a rear mechanism is considered to produce rounder path that includes more elevation change within the path. To a certain degree, the issue of choosing an elliptical machine with either a rear mechanism or a front mechanism is a matter of choice by the user.

One of the inherent characteristics of an elliptical machine is the inherently large size of such equipment. In other words, elliptical exercise machines typically occupy a substantial amount of space within a room and require even more space for proper operation. While space is not a major issue in most commercial settings, such as athletic fitness or sports centers, spas, resorts, etc., the same is not true when the exercise machine is intended for residential use. It is noted that, when in a residential setting, elliptical machines are typically not in use for the majority of the day and, thus, simply consume space for the majority of their existence.

There have been a variety of attempts to provide an elliptical exercise machine that is also "space saving" in some aspect or another. However, such attempts have often resulted in some type of compromise in the overall design of the machine or have not provided the performance or the convenience expected by an end user.

Examples of elliptical machines that have been configured to fold, in an attempt to save space during non-use of the elliptical machine include those described by U.S. Pat. No. 7,775,940 to Dalebout et al., U.S. Pat. No. 6,190,289 to Pyles et al. and PCT Patent Application Publication No. WO2008138124 to Spark Innovations, Inc. The Pyles patent describes an elliptical machine having a front mechanism, wherein foot supports and related components are pivotable upwards toward the control panel/display to be placed in a storage position or state. The Dalebout patent appears to describe an elliptical machine having a rear mechanism, wherein various components are decoupled or disconnected in order to "fold" the elliptical machine into a storage position (and reconnected in order to be placed back into a useable state). The Spark Innovations publication appears to describe an elliptical machine with a rear mechanism wherein the reciprocating arms require adjustment to their positions in order to be transitioned between a useable state and the stored state.

In view of the foregoing, it would be desirable to provide an elliptical exercise machine that maintains all of the beneficial operational functions of prior related elliptical exercise machines while in operation, but that also is capable of substantially reducing the space being occupied by the elliptical exercise machine in a given room when it is not in use.

SUMMARY

In one aspect of the disclosure, an elliptical exercise machine is provided. The elliptical exercise machine includes a first assembly, a second assembly and at least one folding assist mechanism. The first assembly includes a first frame member, a rotational resistance mechanism associated with the first frame member, a first foot support member pivotally coupled to a portion of the rotational mechanism and a second foot support member pivotally coupled to another portion of the rotational mechanism. The second assembly is pivotally coupled with the first assembly and includes a second frame member, a first reciprocating arm pivotally coupled with the second frame member and a second reciprocating arm pivotally coupled with the second frame member. The at least one folding assist mechanism is coupled between the first assembly and the second assembly and is configured to provide resistance to the second assembly as it rotates relative to the first assembly between a first, operating position and a second, folded position.

In another aspect, which may be combined with one or more other aspects, the at least one folding assist mechanism includes a biasing member.

In another aspect, which may be combined with one or more other aspects, the at least one folding assist mechanism includes a damping mechanism.

In another aspect, which may be combined with one or more other aspects, the at least one folding assist mechanism has a first end pivotally coupled with the first frame member and a second end pivotally coupled with the second frame member.

In another aspect, which may be combined with one or more other aspects, the first frame member, the rotational resistance mechanism, the first foot support member and the second foot support member maintain their operational relationships with each other while in both the first position and the second position.

In another aspect, which may be combined with one or more other aspects, the second frame member, the first reciprocating arm and the second reciprocating arm maintain their operational relationships with each other while in both the first position and the second position.

In another aspect, which may be combined with one or more other aspects, the first foot support member is pivotally coupled the first reciprocating arm and wherein the second foot support is pivotally coupled with the second reciprocating arm.

In another aspect, which may be combined with one or more other aspects, the elliptical machine further includes a rotational assist mechanism associated with the first assembly, the rotational assist mechanism including at least one lever arm configured to engage the ground and apply a moment to the elliptical exercise machine.

In another aspect, which may be combined with one or more other aspects, the elliptical exercise machine further includes a plurality of support structures configured to support the elliptical machine in an upright storage position wherein the first frame member extends in a substantially vertical direction.

In another aspect, which may be combined with one or more other aspects, the first assembly includes a rear cross member coupled with the first frame member, wherein the at least one support structure includes one or more support structures coupled with the rear cross member.

In another aspect, which may be combined with one or more other aspects, the first assembly includes a front cross member coupled with the first frame member and a handle coupled with the front cross member.

In another aspect of the disclosure, an elliptical machine is provided that includes a first assembly, a second assembly and a rotational assist mechanism. The first assembly includes a first frame member, a rotational resistance mechanism associated with the first frame member, a first foot support member pivotally coupled to a portion of the rotational resistance mechanism and a second foot support member coupled to another portion of the rotational resistance mechanism. The second assembly includes a second frame member coupled with the first frame member, a first reciprocating arm pivotally coupled with the second frame member and a second reciprocating arm pivotally coupled with the second frame member. The rotational assist mechanism is associated with the first assembly and includes at least one lever arm configured to engage the ground on which the elliptical exercise machine rests and apply a moment to the first assembly.

In another aspect, which may be combined with one or more other aspects, the elliptical exercise machine further includes a locking mechanism associated with the first assembly configured to selectively engage the rotational assist mechanism and prevent the at least one lever arm from engaging the ground.

In another aspect, which may be combined with one or more other aspects, the at least one lever arm includes a first lever arm positioned on a first side of the rear resistance mechanism and a second lever arm positioned on a second, opposing side of the rear resistance mechanism.

In another aspect, which may be combined with one or more other aspects, the elliptical exercise machine includes a plurality of support structures configured to support the elliptical machine in an upright storage position wherein the first frame member extends in a substantially vertical direction.

In another aspect, which may be combined with one or more other aspects, the first assembly includes a rear cross member coupled with the first frame member, wherein the at least one support structure includes one or more support structures coupled with the rear cross member.

In another aspect, which may be combined with one or more other aspects, the first assembly includes a front cross member coupled with the first frame member and a handle coupled with the front cross member.

In another aspect, which may be combined with one or more other aspects, the first frame member is pivotally coupled with the second frame member such that the second assembly is pivotally displaceable relative to the first assembly from a first position to a second position.

In another aspect, which may be combined with one or more other aspects, the elliptical exercise machine further includes a folding assist mechanism coupled between the first assembly and the second assembly, the folding assist mechanism configured to provide resistance to the second assembly as it is displaced from the first position to the second position.

In another aspect, which may be combined with one or more other aspects, the folding assist mechanism includes at least one of a biasing member and a damping member.

BRIEF DESCRIPTION OF THE DRAWINGS

The accompanying drawings illustrate various embodiments of the present methods and systems and are a part of the specification. The illustrated embodiments are merely examples of the present systems and methods and do not limit the scope thereof.

Throughout the drawings, identical reference numbers designate similar, but not necessarily identical, elements.

DETAILED DESCRIPTION

Figure 1:
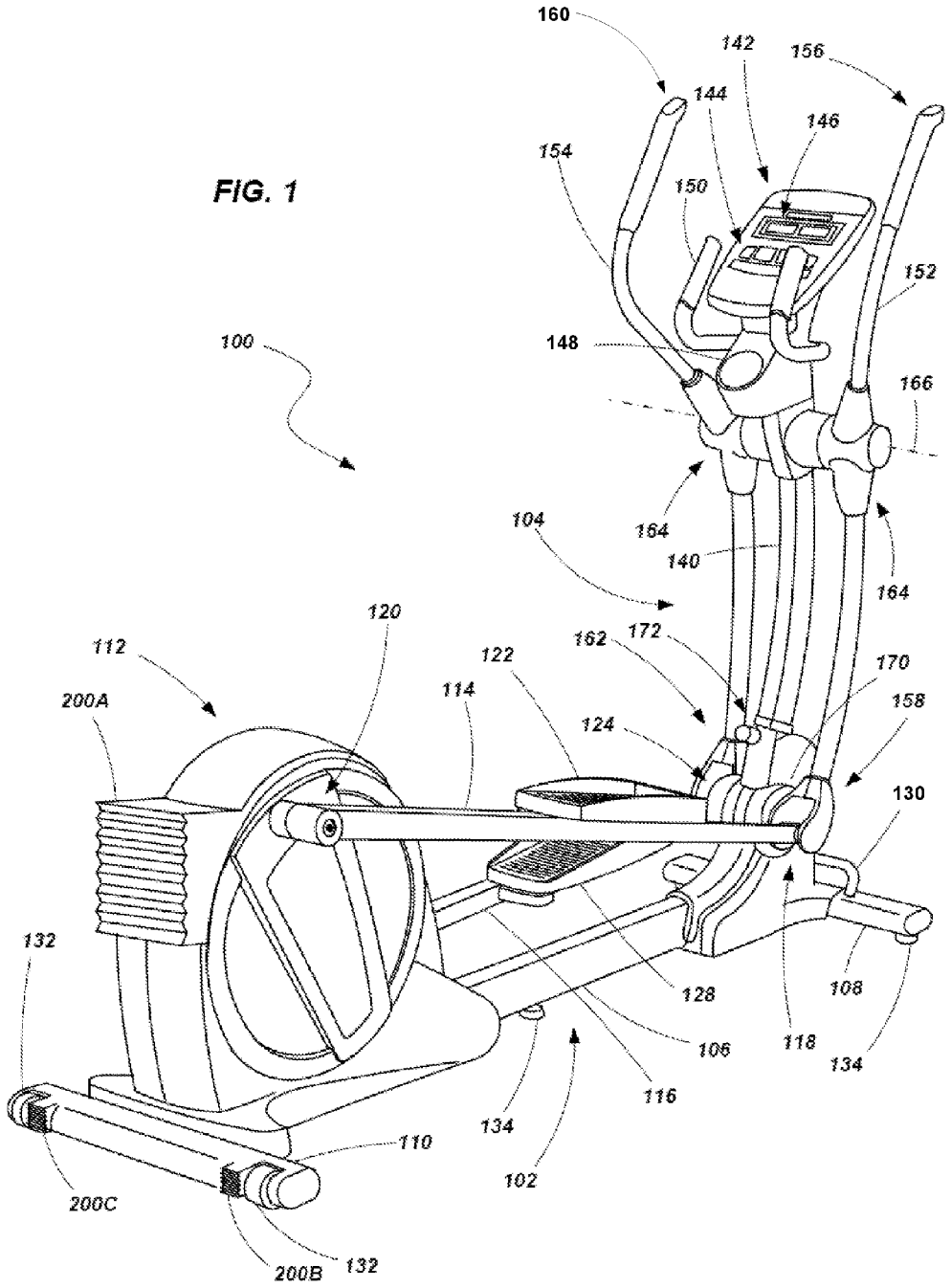
FIG. 1 is a perspective view of an elliptical exercise machine.
Figure 2:
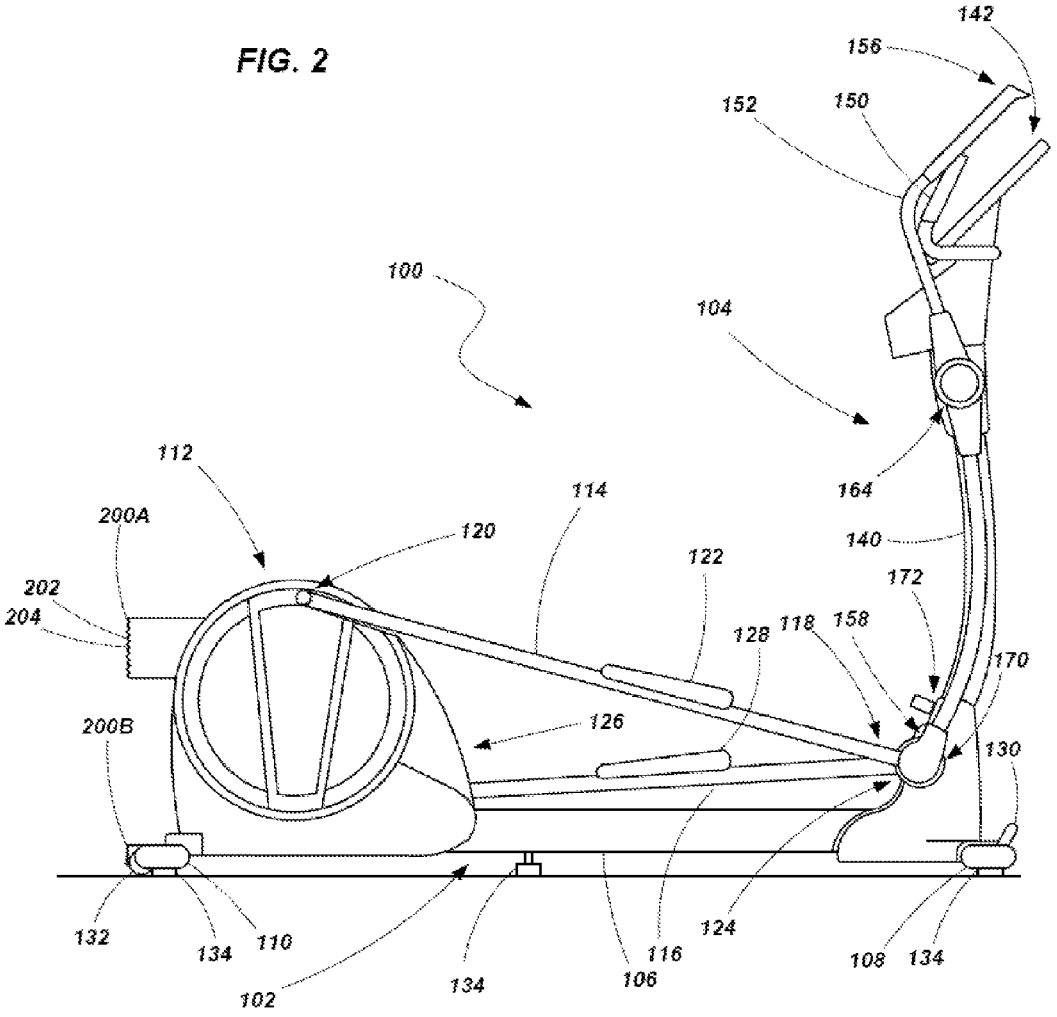
FIG. 2 is a first side view of the elliptical machine shown in FIG. 1.

Referring to FIGS. 1 and 2, an elliptical exercise machine 100 is shown and described. The elliptical exercise machine 100 includes a first assembly 102 operatively coupled with a second assembly 104. The first assembly 102 includes a longitudinal frame member 106 coupled with a first foot or cross member 108 and a second foot or cross member 110. A rear drive/resistance mechanism 112 (referred to herein as the rear mechanism 112 for convenience) is coupled with the frame member 106 and may include, for example, a flywheel and a resistance mechanism as will be appreciated by those of ordinary skill in the art. The resistance mechanism may include a magnetic braking mechanism, sometimes referred to as an eddy current brake, to provide a desired level of resistance to the user during operation of the exercise machine 100. While described in connection with an exercise bicycle, one example of a flywheel, as well as an associated magnetic braking mechanism, is described by U.S. Patent Application Publication No. 2012/0088638 to Lull (application Ser. No. 13/267,719), the disclosure of which is incorporated by reference herein in its entirety.

The lower assembly 102 further includes a first reciprocating foot support 114 and a second reciprocating foot support 116. The first foot support 114 has a first end 118 and a second end 120, the second end 120 being pivotally coupled with the rear mechanism 112 such that the second end 120 of the foot support 114 travels in a substantially circular path during operation of the elliptical machine 100. A foot pad 122 is disposed on the first foot support at a location between the first end 118 and the second end 120. The foot pad 122 is sized and configured to receive and support a foot of a user and may either be integrally formed with the foot support 114 or formed as a separate component and coupled with the foot support 114 (e.g., by fasteners, adhesive, or other mechanical or material techniques). The second reciprocating foot support 116 likewise includes a first end 124 and a second end 126, with the second end 126 being pivotally coupled with the rear mechanism 112 such that the second end 126 of the foot support 116 travels in a substantially circular path during operation of the elliptical machine 100. A second foot pad 128 is disposed on the second foot support 116 at a location between the first end 124 and the second end 126.

The first and second reciprocating foot supports 114 and 116 are laterally spaced apart from one another such that each of the corresponding foot pads 122 and 128 receive the right and left feet, respectively, of a user for facilitating a striding motion with the user during use of the machine 100. The foot pads 122 and 128 may be configured with surface features (e.g., ribs, grooves, knobs, etc) to provide traction to the foot of a user. In other embodiments, while the foot pads may not necessarily include surface features, they may include a non-slip material to provide traction to the foot of a user. The foot pads 122 and 128 may be adjustable relative to their associated foot supports 114 and 116 such that they may be positioned at different locations along the lengths of the foot supports 114 and 116 to accommodate the preferences of different users.

The first assembly 102 may include a number of additional components or features. For example, a handle 130 may be coupled with front cross member 108 to assist in lifting or moving the elliptical machine 100. Additional handles may be coupled to other portions of the elliptical machine 100 to further enable a user to more easily lift or move the elliptical machine 100. One or more wheels 132 may be coupled to the rear cross member 110 to enable a user to more easily move the elliptical machine 100 from one location to another by, for example, lifting on the front handle 130 and rolling the elliptical machine 100 across the floor. Additionally, feet or support pads 134 may be coupled to various portions of the first assembly 102 and may be configured to engage the floor or a supporting surface. The support pads 134 may be adjustable so that the elliptical machine 100 may be leveled on a given surface prior to operation by a user. It is noted that in one embodiment, the under surface of the cross members 108 and 110 may serve as support pads. In another embodiment, caps positioned over the ends of the cross members 108 and 110 may serve as support pads.

The second assembly 104 includes an upright frame member 140 with a control panel 142 coupled therewith. The control panel 142 may include a variety of input devices 144 (e.g., switches, buttons, touch pads) and output devices 146 (e.g., graphic displays, lights, audio speakers) to facilitate control of the elliptical machine 100. The input devices 144 may be used to turn the elliptical machine 100 on or off, to control the amount of resistance being applied to the flywheel of the rear mechanism 112, to enable preset exercise programs, or to otherwise control the operation of the elliptical machine. The various output devices 146 may be used to provide a user with an indication of the operating status of the elliptical machine 100 and to provide other information (e.g., time exercised, calories burned, etc.) to the user.

A variety of additional components may also be coupled with the frame member 140. For example, a tray 148, which may include a cup holder or other structure, may be coupled with the frame member 140. Also, a pair of stationary hand grips 150 may be coupled with the upright frame member 140. While not specifically shown, other components, such as a fan, may also be coupled with the frame member 140 as will be recognized by those of ordinary skill in the art.

The second assembly 104 also includes a first reciprocating arm 152 and second reciprocating arm 154. The first reciprocating arm 152 includes a first end 156 and a second end 158. Similarly, the second reciprocating arm 154 includes a first end 160 and a second end 162. Upper portions of the reciprocating arms 152 and 154 near the first ends 156 and 160 are configured as grips or handles for a user to grasp with their hands while exercising. The second ends 158 and 162 of the reciprocating arms 152 and 154 are pivotally coupled with the first ends 118 and 124 of the foot support members. Each of the reciprocating arms 152 and 154 are pivotally coupled to the frame member 140 through associated pivoting structures 164. The pivoting structures 164 may include, for example, a bearing member that enables the reciprocating arms to pivot back and forth along an axis of rotation 166 in a reciprocating fashion.

During operation of the elliptical machine 100, a user places their feet on the foot pads 122 and 128 and applies a force in order to motivate the foot supports 114 and 116 to move through their defined looping pathways. The pathway of the foot supports 114 and 116 (and thus the foot pads 122 and 128) is defined in part by the connection of the foot supports 114 and 116 with the rear mechanism 112 and in part by the connection of the foot supports 114 and 116 with the reciprocating arms 152 and 154.

In addition to the two assemblies 102 and 104 being connected by way of the pivoting connection of the foot supports 114 and 116 with associated reciprocating arms 152 and 154, the longitudinal frame member 106 is pivotally coupled with the upright frame member 140 by a pivoting structure 170. Again, the pivoting structure 170 may include a bearing component (e.g., a sleeve bearing, a roller bearing, or other appropriate structure) to accommodate pivoting movement of the upright frame member 140 relative to the longitudinal frame member 106. Associated with the pivoting structure 170, a locking or coupling mechanism 172 may be used to affirmatively maintain the frame members 106 and 140 (and, thus, the assemblies 102 and 104) in their operating positions as shown in FIGS. 1 and 2 and as will be described in further detail below.

Figure 3:
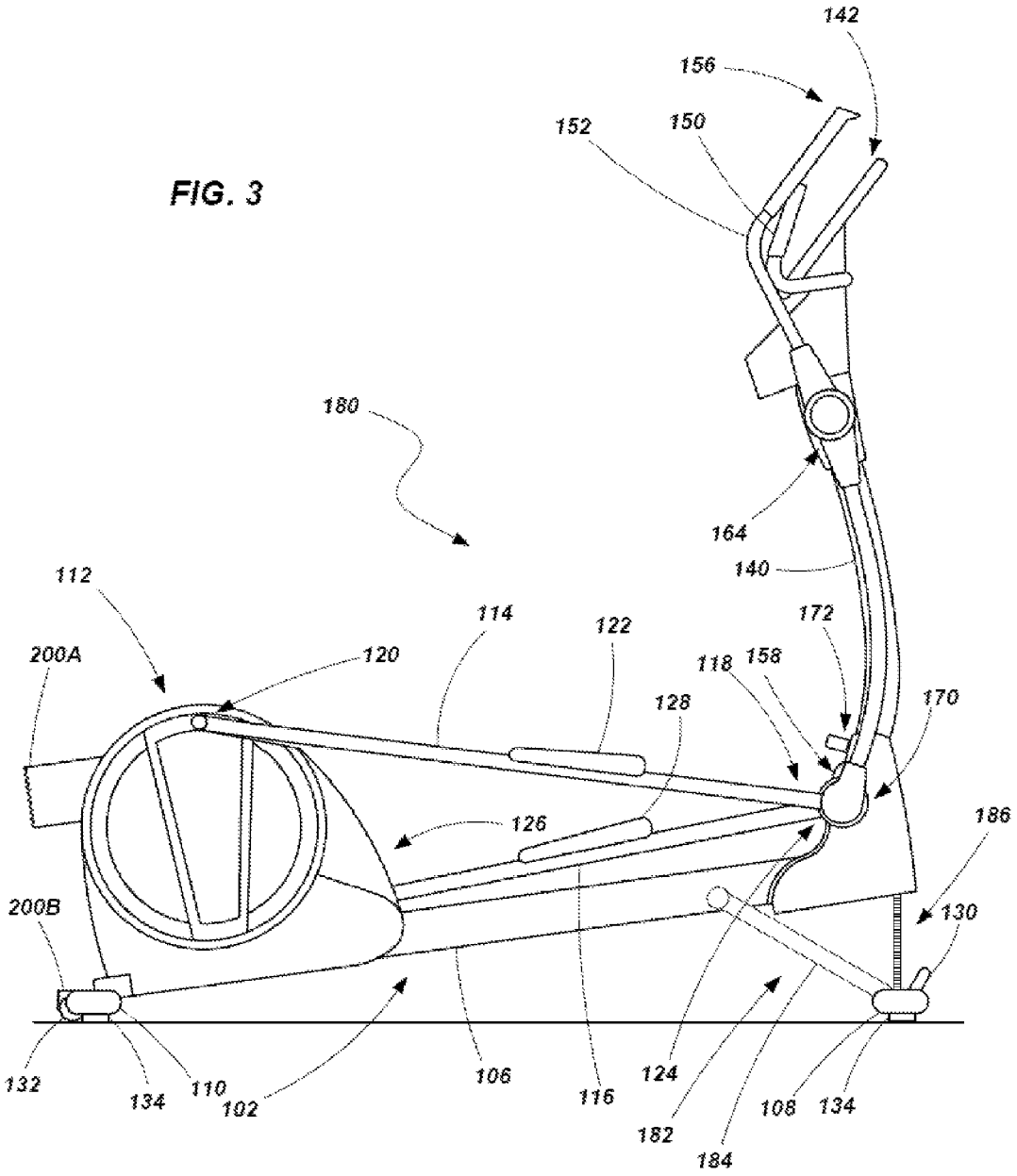
FIG. 3 is side view of an elliptical machine according to another embodiment.

Referring briefly to FIG. 3, another embodiment of an elliptical exercise machine 180 is shown. The elliptical machine is similar to that shown and described with respect to FIGS. 1 and 2 above, including a first assembly 102, a second assembly 104 and the various components described above. The elliptical machine 180 shown in FIG. 3 further includes an incline adjustment mechanism 182 that enables selective height adjustment of the front cross member 108 relative to the rear cross member 110, thereby altering the angular orientation of the foot supports 114 and 116 and their associated pathways. The incline adjustment mechanism 182 may include, for example, a pair of arms 184 or links (one shown in FIG. 3) pivotally coupled between the front cross member 108 and the longitudinal frame member 106, as well as an actuator 186, such as a jackscrew, a pneumatic cylinder, a stepper motor or other appropriate actuating mechanism.

Figure 4:
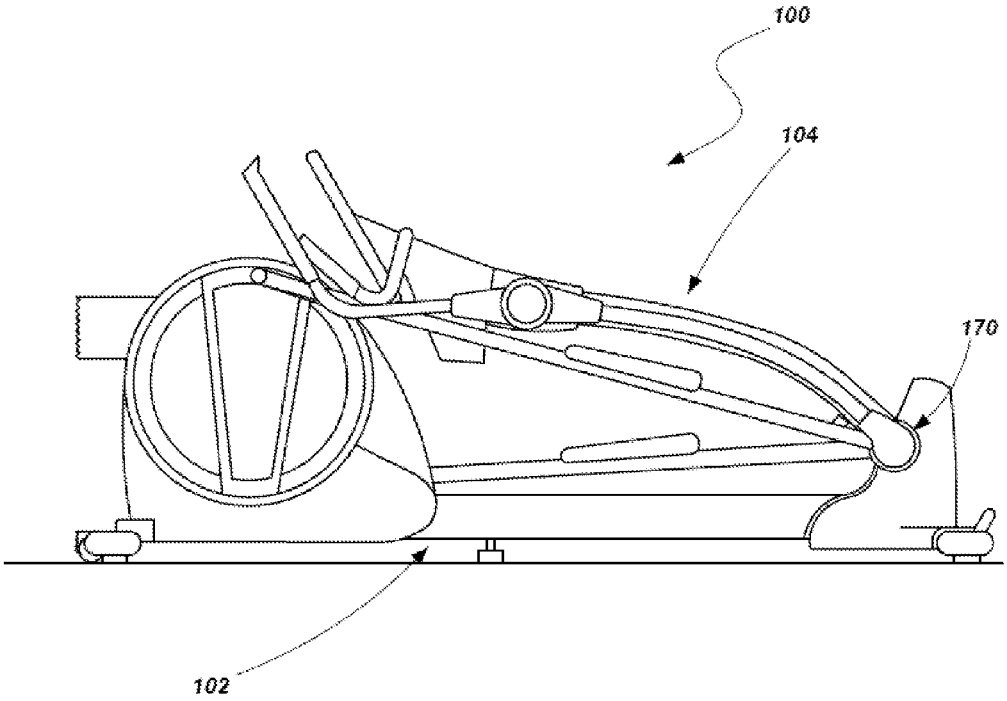
FIG. 4 is a side view of the elliptical machine shown in FIGS. 1 and 2 while in a stowed or stored position.

Referring now to FIG. 4, the elliptical machine 100 is shown in a folded or storage position, wherein the second assembly 104 has been rotated about the pivot structure 170 relative to the first assembly 102 such that the upper portion of the second assembly 104 (e.g., the control panel 142, the hand grips 150) are positioned adjacent the rear portion of the first assembly 102 (e.g., the rear mechanism 112). It is noted that the embodiment described with respect to FIG. 3 is also configured to fold or transition into a collapsed or storage condition in a manner similar to that shown in FIG. 4. In one embodiment, such folding or collapsing of the elliptical machine 180 shown in FIG. 3 may be enabled regardless of the current inclined position of the elliptical machine 180. In another embodiment, the pivoting structure 170 of the elliptical machine 180 may be configured to remain in a locked state until the elliptical machined 180 is in a predefined inclination position (e.g., completely lowered to toward the floor or supporting surface).

Figure 5:
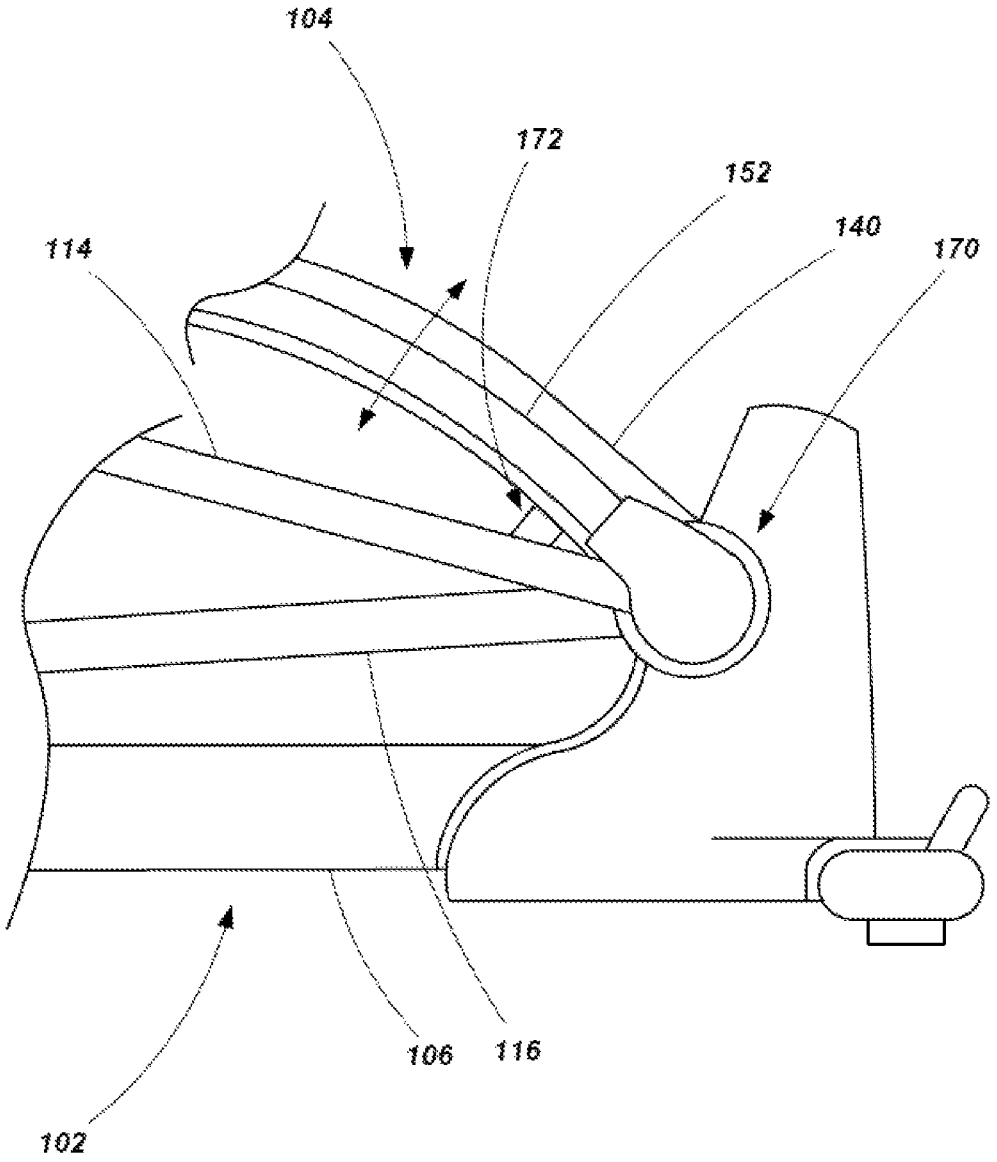
FIG. 5 is an enlarged detail view of certain portions the elliptical machine as shown in FIG. 4.

Referring briefly to FIG. 5, an enlarged view of the various components of the elliptical machine 100 are shown in a folded or collapsed state. FIG. 5 shows the second assembly 104 rotated about the pivot structure 170 relative to the first assembly 102. It is noted that, when in the position or state shown in FIGS. 4 and 5, the pivotal axes of the connections between foot supports 114 and 116 and associated reciprocating arms 152 and 154 are aligned with the pivotal axis of the pivot structure 170 which couples the longitudinal frame member 106 and the upright frame member 140.

Figure 6:
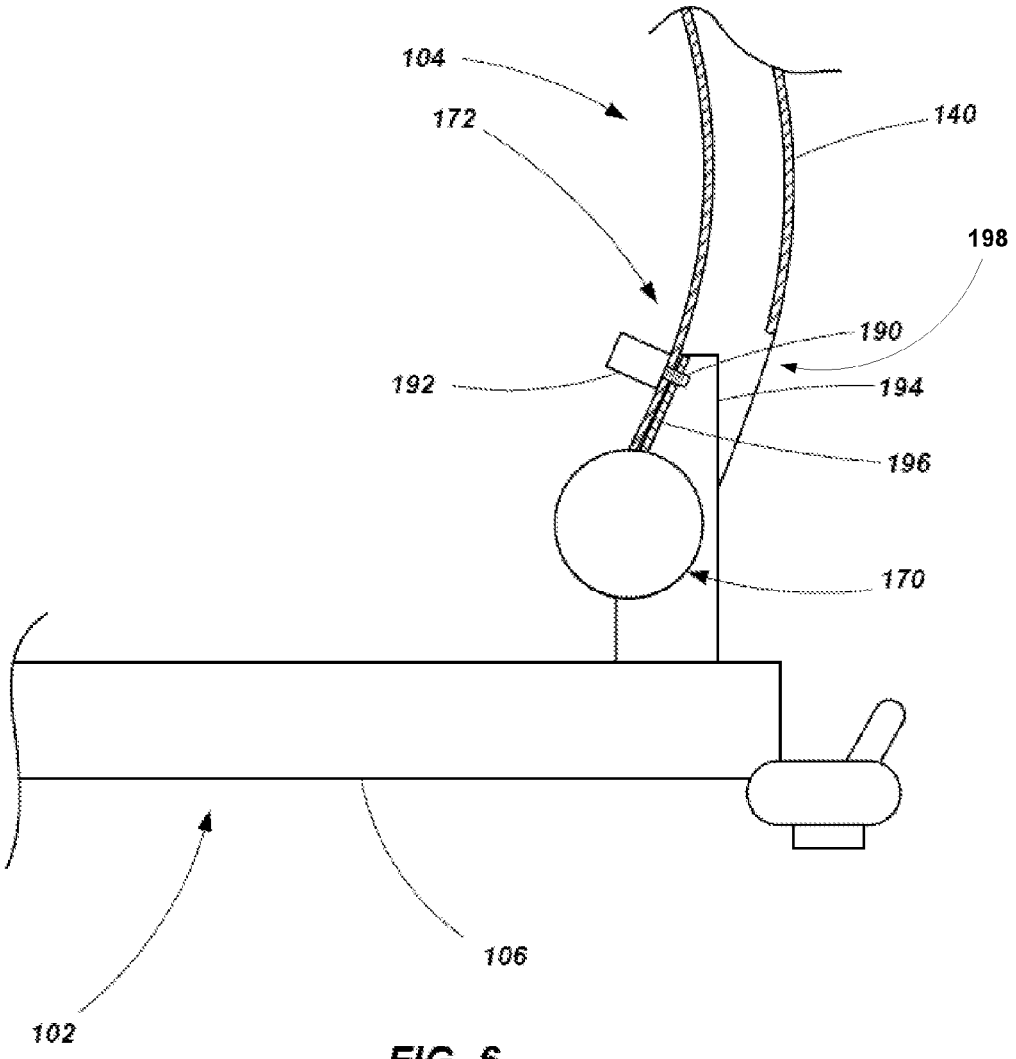
FIG. 6 is a partial cross-sectional view of a portion of the elliptical machine.

Referring to FIG. 6, a partial cross-sectional view is shown of portions of the first and second assemblies 102 and 104 including a locking or coupling mechanism 172 which is engaged to maintain the first and second assemblies 102 and 104 in their operating positions. In one embodiment, the coupling mechanism 172 may include a fastener 190 having a handle or knob 192 coupled therewith enabling a user to rotate the fastener by hand (i.e., without the need for additional tools). The fastener 190 may be configured to be rotationally coupled with the upright frame member 140 of the second assembly 104. The fastener may be configured to threadably engage a structure or component of the first assembly 102. For example, a post 194 or other structural component may be coupled with the longitudinal frame member 106 and include, for example, a plate 196 through which a threaded aperture is formed. The fastener 190 may then selectively engage and disengage the threaded aperture in order to either maintain the first and second assemblies 102 and 104 in an operating condition (as shown in FIGS. 1, 2, 3 and 6) or to enable relative rotation of the first and second assemblies 102 and 104 so that they may be placed in a stored or collapsed condition (as depicted in FIGS. 4 and 5). While the embodiment shown in FIG. 5 includes a fastener 190 used to affirmatively couple the first assembly 102 and the second assembly 104 in an operating position, other mechanisms and structures may also be used. For example, a locking mechanism with a cam surface may be used to provide an affirmative coupling. Other examples may include locking pins that may be inserted in aligned apertures of different components of the first and second assemblies 102 and 104.

It is noted that the upright arm 140 of the second assembly 104 is configured such that it does not interfere with the post 194 or plate 196 (or other similar structure) when rotating between an operational position and a collapsed position. For example, if the upright arm 140 is formed from structural tubing (e.g., with a square or rectangular cross-section), a portion of the tubing may be removed, as shown in FIG. 6, to provide an opening 198 that enables non-interfering rotation of the upright frame member 140 relative to the post 194 and plate 196.

While not specifically shown, a mechanism or structure may be also be provided to lock the first and second assemblies 102 and 104 in a collapsed position so that, for example, if an individual desires to move the elliptical machine 100 (or 180) while it is in the collapsed position, the first and second assemblies 102 and 104 will maintain their positions relative to each other.

Figure 7:
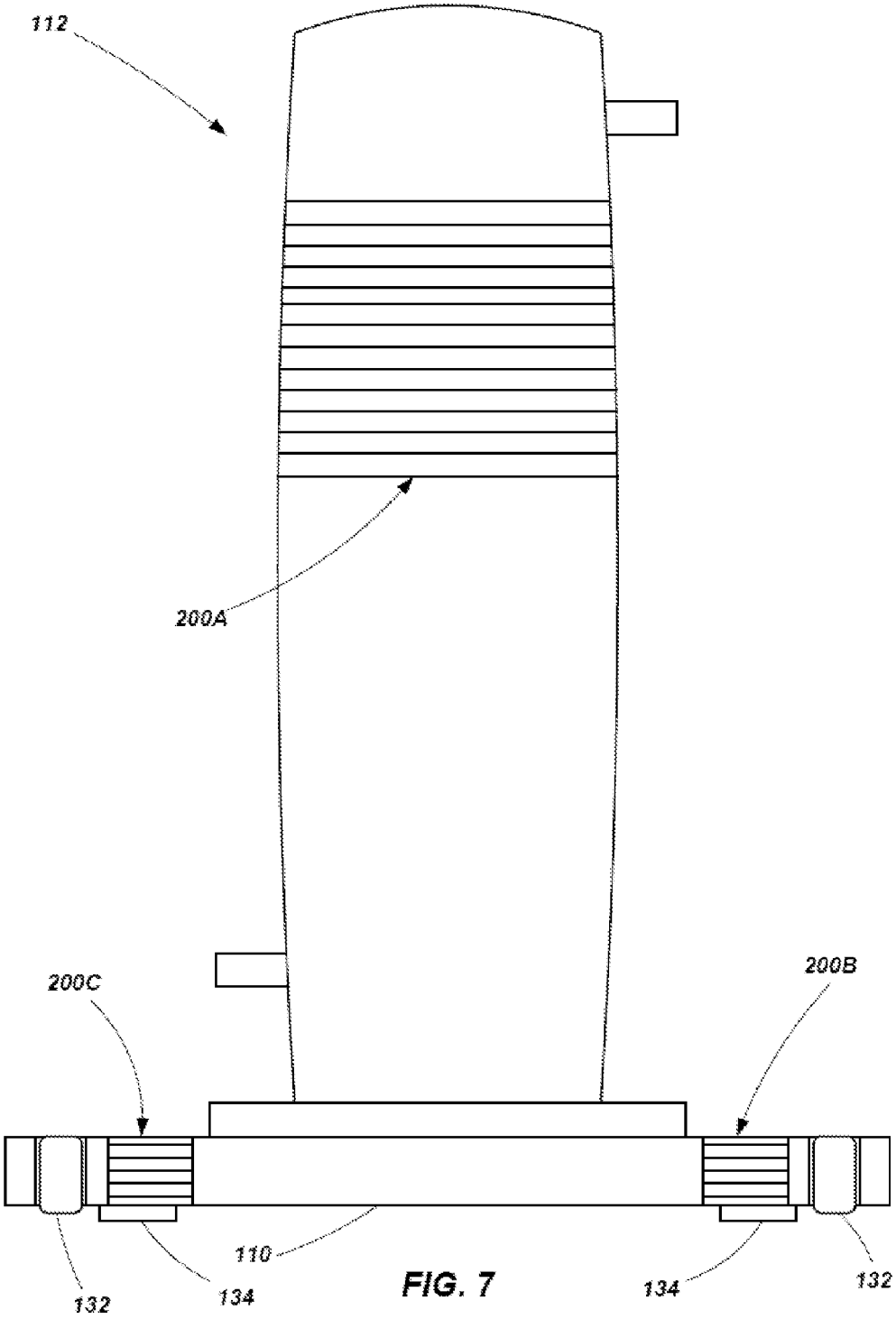
FIG. 7 is a rear view of the elliptical machine shown in FIG. 1.

Referring now to FIG. 7, in conjunction with FIGS. 1-3, the elliptical machine 100 (or 180 as shown in FIG. 3) may further include features or mechanisms configured to enable the elliptical machine to be stored in an "upright" position after being folded in a stable and secure manner. In one embodiment, a stabilizing mechanism or system may be provided which includes, for example, a plurality of support surfaces 200A-200C. The support surfaces 200A-200C may be located at the rear portion of the elliptical machine 100. For example, one support surface 200A may be associated with, or located adjacent to, the rear mechanism 112, and may be formed in a cover or faring associated with the rear mechanism 112. Other support surfaces (e.g., 200B and 200C) may be associated with the rear cross member 110.

Figure 8:
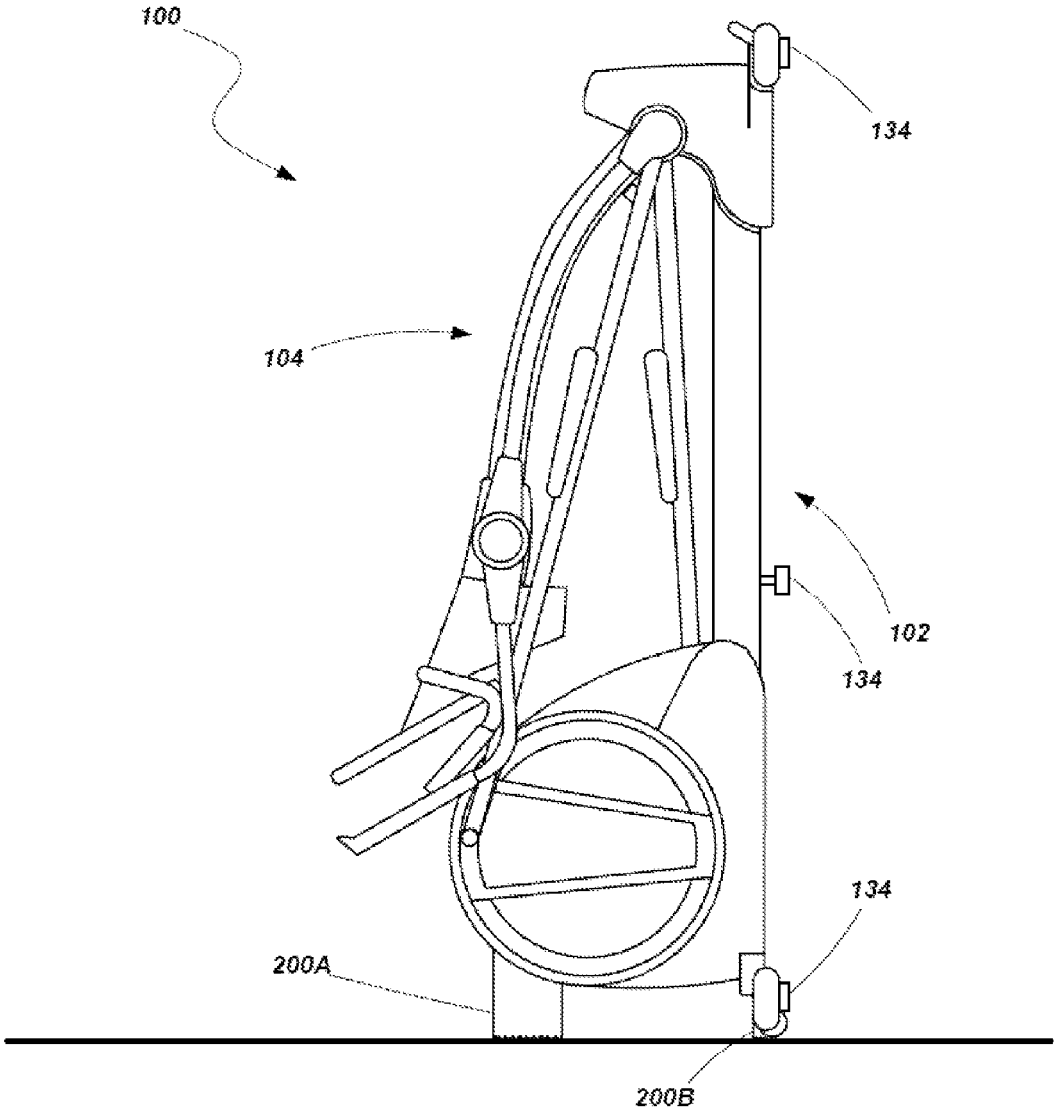
FIG. 8 is a side view of the elliptical machine shown in FIGS. 1 and 2 while in another stowed or stored position.

As seen in FIG. 8, the multiple support surfaces 200A-200C work together to support the elliptical machine 100 in a stable upright position. It is noted that the support surfaces 200A-200C define a common plane to support the elliptical machine 100 in an upright position with the frame member 106 of the second assembly 102 extending substantially vertically. When in this position, the entire elliptical machine 100 is rotated through a defined angle relative to that shown, for example, in FIG. 2. In one embodiment, this defined angle may be between approximately 75° and approximately 105°. In one particular embodiment, the defined angle may be approximately 90°. Stated another way, the support pads 134 may include engagement surfaces (to engage the ground or floor) that are all positioned substantially in a first plane while the support structures 200A-200C may each include engagement surfaces (to engage the ground or floor) that are all positioned substantially in a second plane, the first plane and the second plane being at a defined angle relative to each other (e.g., approximately 90°, or between approximately 75° and approximately 105°).

While three distinct support surfaces are shown in the presently depicted embodiment, a configuration may be employed where a different number of support surfaces are used, with each lying substantially within a common plane such that the elliptical machine may be support in an upright manner. Additionally, the support structures may be located at different positions than shown in the drawings, and/or associated with different components than shown in the drawings if desired.

As seen in FIGS. 1-4, 7 and 8, the support surfaces 200A-200C may be configured to provide a desired level of friction so as to engage the ground in a non-slip manner when the elliptical machine is in an upright position. For example, the support surfaces 200A-200C may include a plurality of protrusions to engage the ground. In the example shown, the protrusions are defined as substantially parallel ridges 202 with grooves 204 extending therebetween. However, other configurations are also contemplated. For example, a gnarled surface, a generally undulating surface, a surface coated with a material having a relatively high coefficient of friction, or other configuration may be used.

In one embodiment, the support surfaces 200A-200C may be formed from a relatively rigid material including, for example, a plastic, a metal or a metal alloy material. In another embodiment, the body of the support surface may be formed of a relatively rigid material, while the surface that engages the ground is formed from somewhat less rigid material (e.g., a coating formed of a rubber or polymer material) so that the support surfaces 200A-200C may engage a hard floor (e.g., wood or tile) without marring the floor. In yet another embodiment, the support surfaces 200A-200C may be formed of a relatively rigid material, and a removable cap may be formed of a different material (e.g., a softer or less rigid material) may be fitted over the ends of the support surfaces 200A-200C that will engage the floor when in an upright position.

Figure 9A:
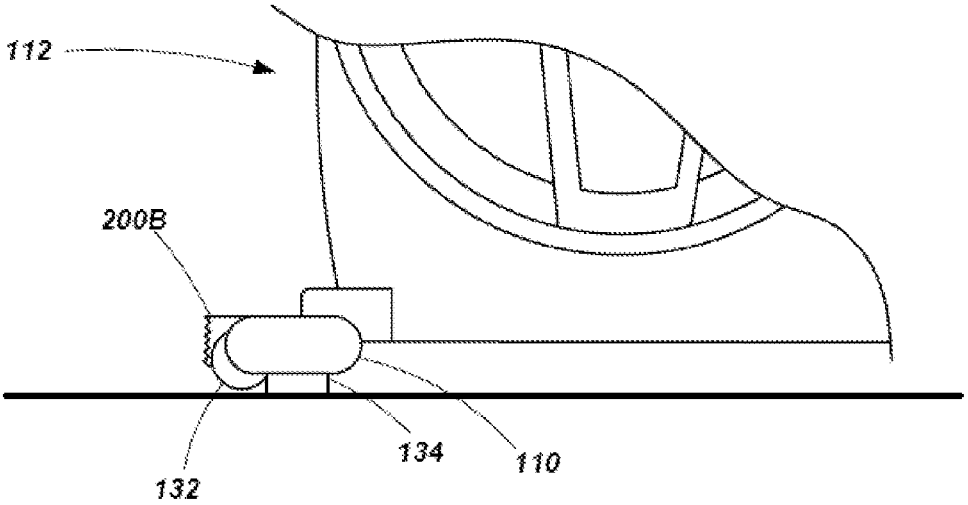
FIGS. 9A-9C are enlarged detail views of various components of an elliptical machine while in different states.
Figure 9B:
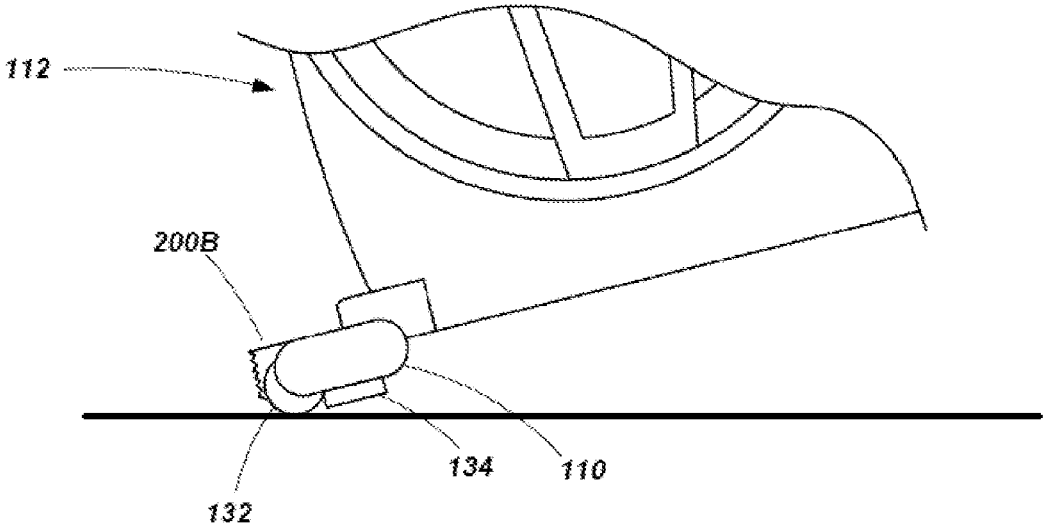
Figure 9C:
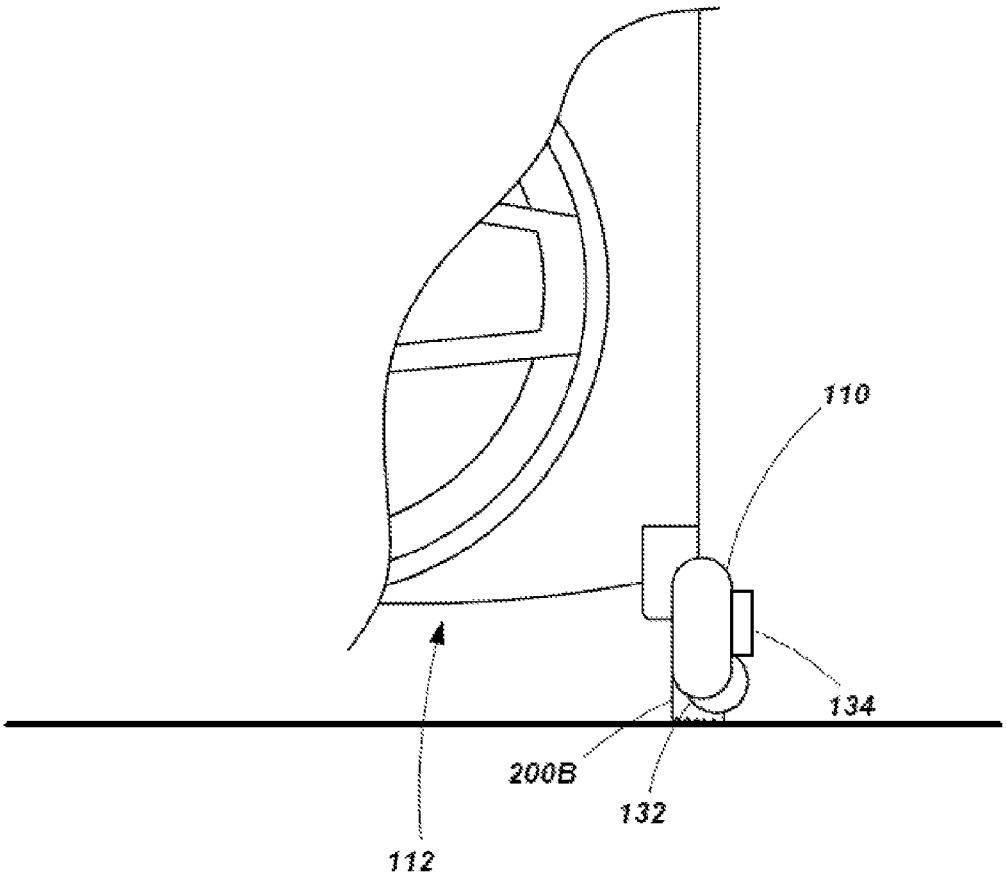

Referring now to FIGS. 9A-9C (in conjunction with the other drawings generally), an enlarged view of a rear portion of the elliptical machine 100 is shown while in different positions. FIG. 9A depicts a portion of the rear mechanism 112 with the rear cross member 110 (and associated support member 200B, wheel 132 and support pad 134) when the elliptical machine 100 is in a position for use (e.g., as shown in FIGS. 1 and 2), or when the elliptical machine 100 is in a folded state (e.g., FIG. 4) but has not been placed in an upright position. As seen in FIG. 9A, the support pad 134 is resting on the ground supporting the elliptical machine 100 while the wheel 132 is slightly off the ground and the support surface 200B is also not touching the ground.

FIG. 9B depicts the same components as FIG. 9A, but with the front end of the elliptical machine lifted upwards such that support pad 134 associated with the front cross member 108 (FIGS. 1-3) is lifted off the ground. With the elliptical machine 100 being rotated or pivoted to a defined angle relative to the ground, the support pad 134 no longer contacts the ground, the wheel 132 now engages the ground so that, if desired, the elliptical machine may be easily rolled to a different location, and the support structure 200B is still out of engagement with the ground.

FIG. 9C depicts the same components as FIGS. 9A and 9B, except the elliptical machine is now in an upright position (such as shown in FIG. 8) with the support structure 200B in contact with the ground. While in this position, the wheel 132 and the support pad 134 are both out of engagement with the ground.

It is noted that, in other embodiments, it is possible, for example, for the wheel 132 to remain in contact with the ground simultaneously with the support pad 134 while the elliptical machine 100 is in a position for user or operation by a user. Additionally, or alternatively, it is possible for the wheel 132 to remain engaged with the ground simultaneously with the support structure 200B while the elliptical machine 100 is in an upright position such as shown in FIG. 8.

Figure 10:
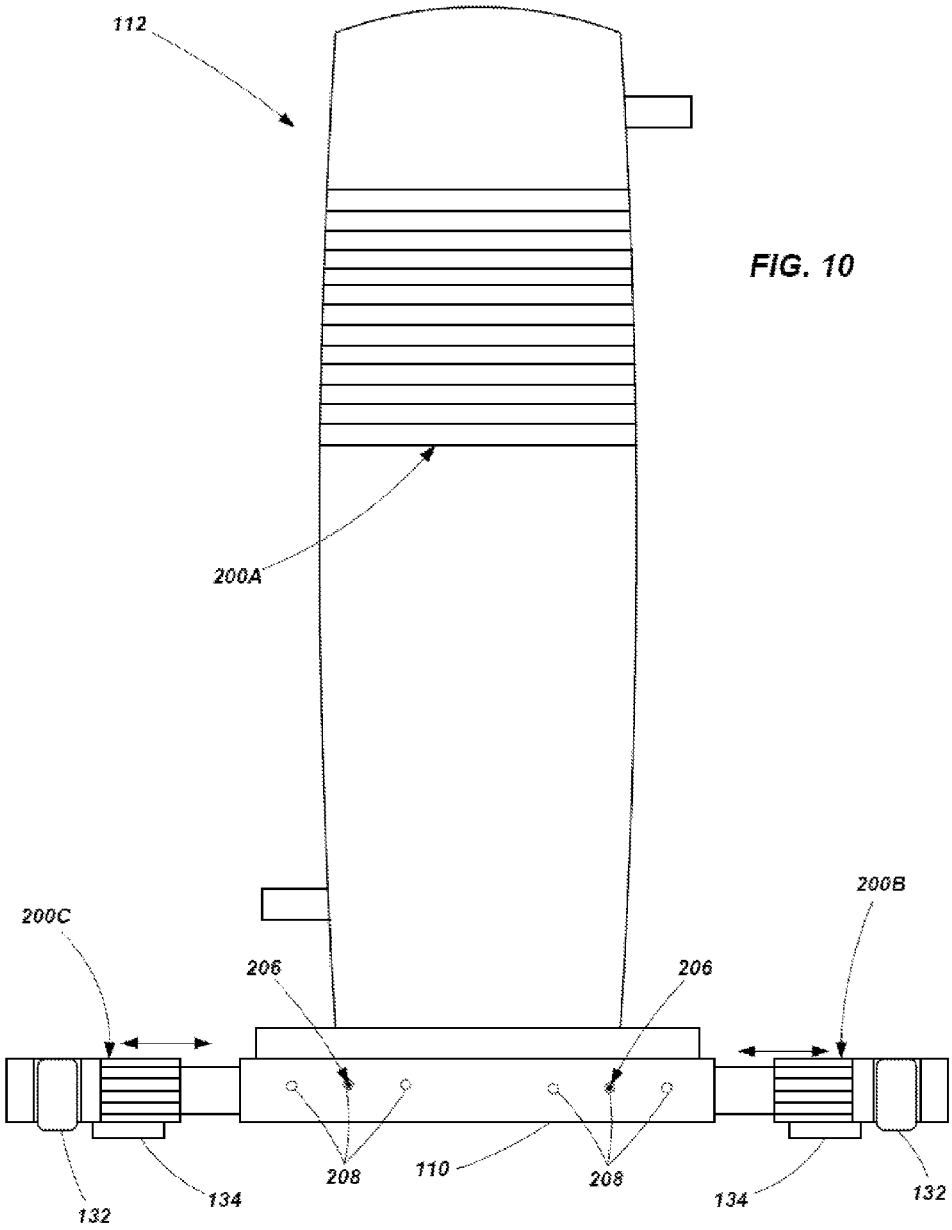
FIG. 10 is a rear view of an elliptical machine in accordance with another embodiment.

Referring briefly to FIG. 10, a rear view of an elliptical machine is shown wherein one or more of the support surfaces 200A-200C are configured to be adjustable. For example, the support structures 200B and 200C associated with the rear cross member 110 may be selectively adjusted between a number of lateral positions. Such may be accomplished, for example, by configuring the rear cross member 110 to include telescoping sections 110A and 110B. The telescoping sections 110A and 110B may be selectively locked at one of a variety positions using, for example, a biased detent or spring-pin mechanism 206 configured to serially engage a plurality of openings or apertures 208 formed in a portion of the rear cross-member 110. While not specifically shown, the upper support structure 200A may be configured to be selectively displaced in addition to, or in alternative to, the support structures 200B and 200C associated with the rear cross-member 110.

Figure 11:
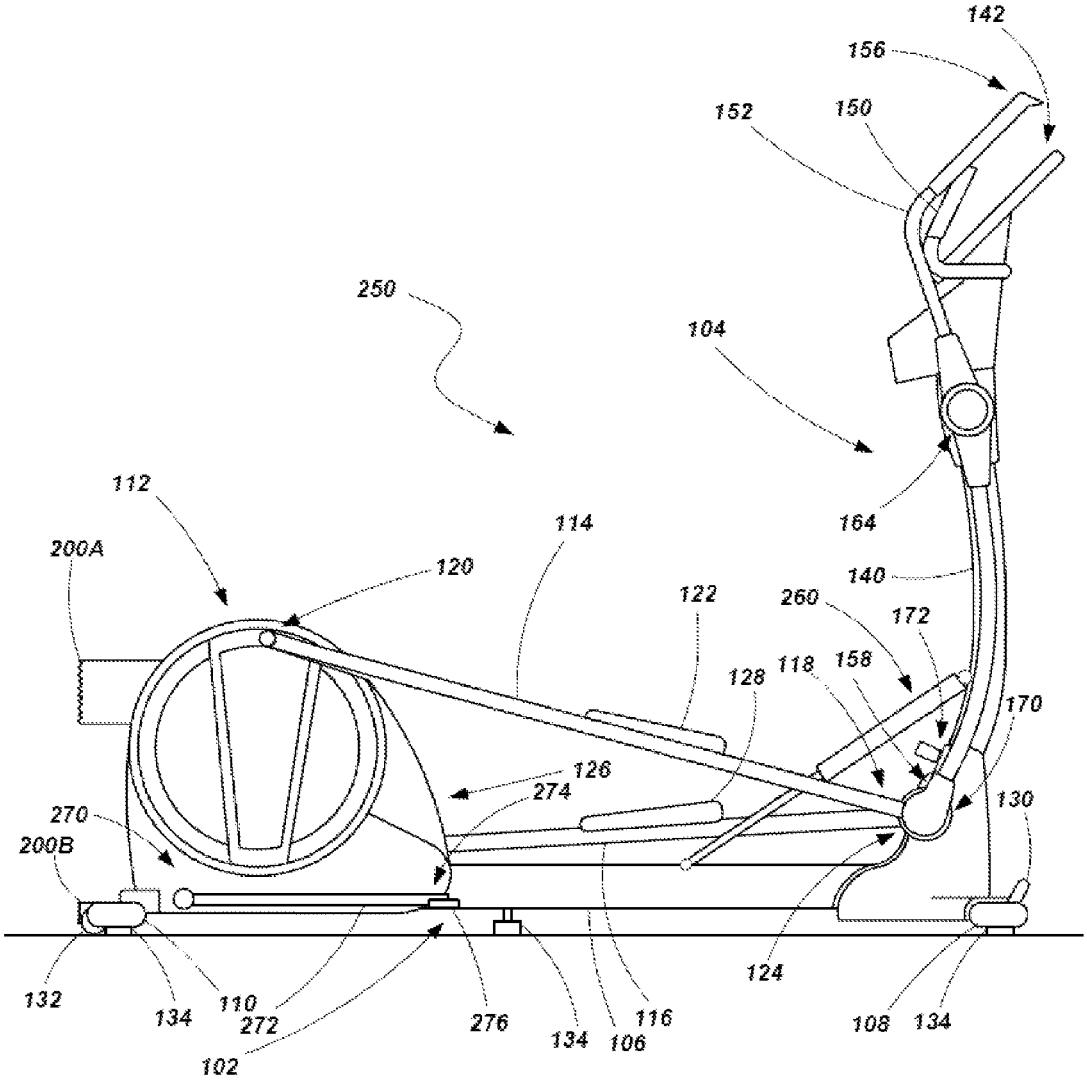
FIG. 11 is a side view of an elliptical machine in accordance with other aspects of the invention, the elliptical machine being shown in an operational position.
Figure 12:
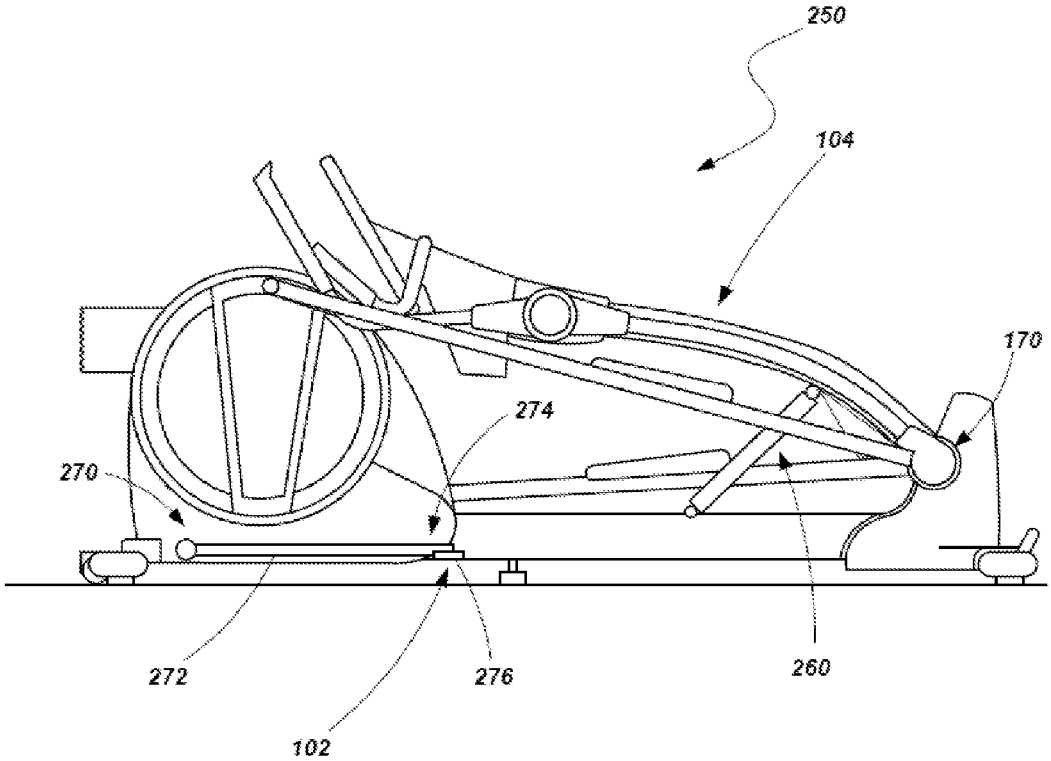
FIG. 12 is a side view of the elliptical machine shown in FIG. 11 while in a folded state or position.

Referring now to FIGS. 11 and 12, another embodiment of an elliptical machine 250 is shown which includes numerous components similar to the embodiments described above. For example, the elliptical machine 250 includes a first assembly 102, a second assembly 104 and the various components described above. The elliptical machine further includes a folding assist mechanism 260 which may be coupled between a component associated with the first assembly 102 and a component associated with the second assembly 104. For example, the folding assist mechanism may include a first end pivotally coupled to the longitudinal frame member 106 and a second end pivotally coupled with the upright frame member 142. The folding assist mechanism 260 may be configured to provide a biasing force between the first assembly 102 and the second assembly 104 such that, when a person is folding or collapsing the second assembly 104 relative to the first assembly 102, the second assembly does not inadvertently fall or slam downwards onto the first assembly 102. Rather, the folding assist mechanism 260 may enable a gentle transition of the second assembly 104 from an upright position (FIG. 11) to a folded position (FIG. 12). The folding assist mechanism 260 may also assist in lifting the second assembly 104 from the folded position to the upright position such that users of different strength levels, including those that are smaller or relatively weaker, can still lift the second assembly 104 to the upright position without straining and with reduced effort.

In one embodiment, the folding assist mechanism 260 may include, for example a biasing member such as a coil spring. In another embodiment, the folding assist mechanism 260 may include a gas charged cylinder or other damping mechanism to provide resistance to the transition of the second assembly 104 from an upright position to a folded position. In yet another embodiment, the folding assist mechanism 260 may include both a biasing member and a damping member.

As also seen in FIG. 11, the elliptical machine may further include a rotational assist mechanism 270. The rotational assist mechanism 270 may be associated with the first assembly 102 and be configured to assist in rotating the elliptical machine 250 to and from an upright storage position. For example, the rotational assist mechanism 270 may include a lever arm 272 having one end pivotally coupled with a component of the first assembly 102, such as the longitudinal frame 106, near the rotational mechanism 112. A spring (e.g. a torsional spring) or other biasing member may provide a rotational force to the lever arm 272 such that its free end 274 is biased in a downward direction toward the ground or floor. A catch 276 or locking mechanism may be used to hold the lever arm 272 in a desired position when it is not needed or desired to assist in rotating the elliptical machine 250 to or from an upright storage position. It is noted that, while a lever arm 272 is depicted as being on one side of the elliptical machine 250 (e.g., on one side of the rear mechanism 112), another lever arm may be positioned on the opposing side of the elliptical machine 250 (e.g., on the opposing side of the rear mechanism 112).

Figure 13A:
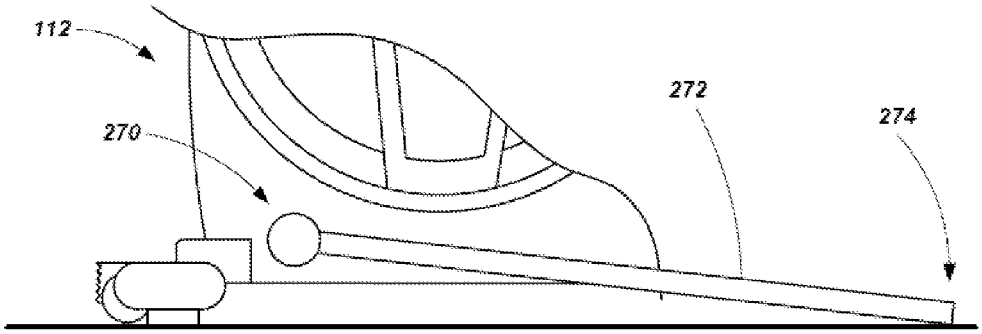
FIGS. 13A-D show enlarged views of various components of the elliptical machine shown in FIGS. 11 and 12 with the elliptical machine transitioning from a first position to an upright position for storage.
Figure 13B:
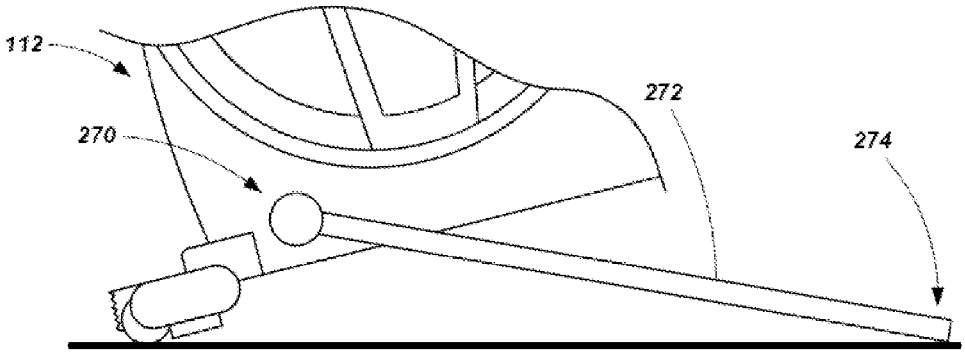
Figure 13C:
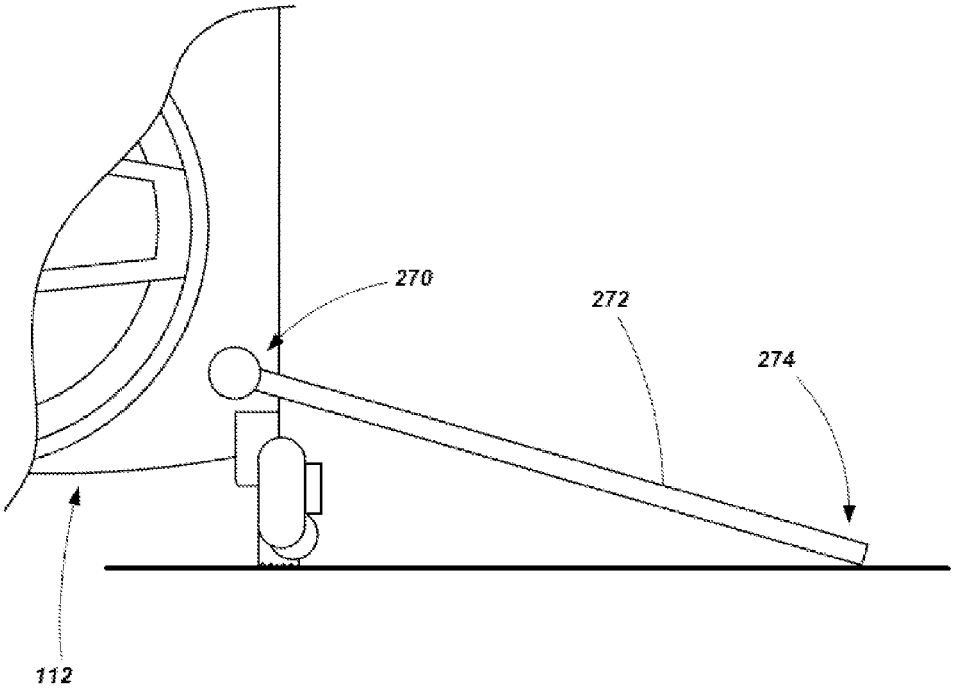
Figure 13D:
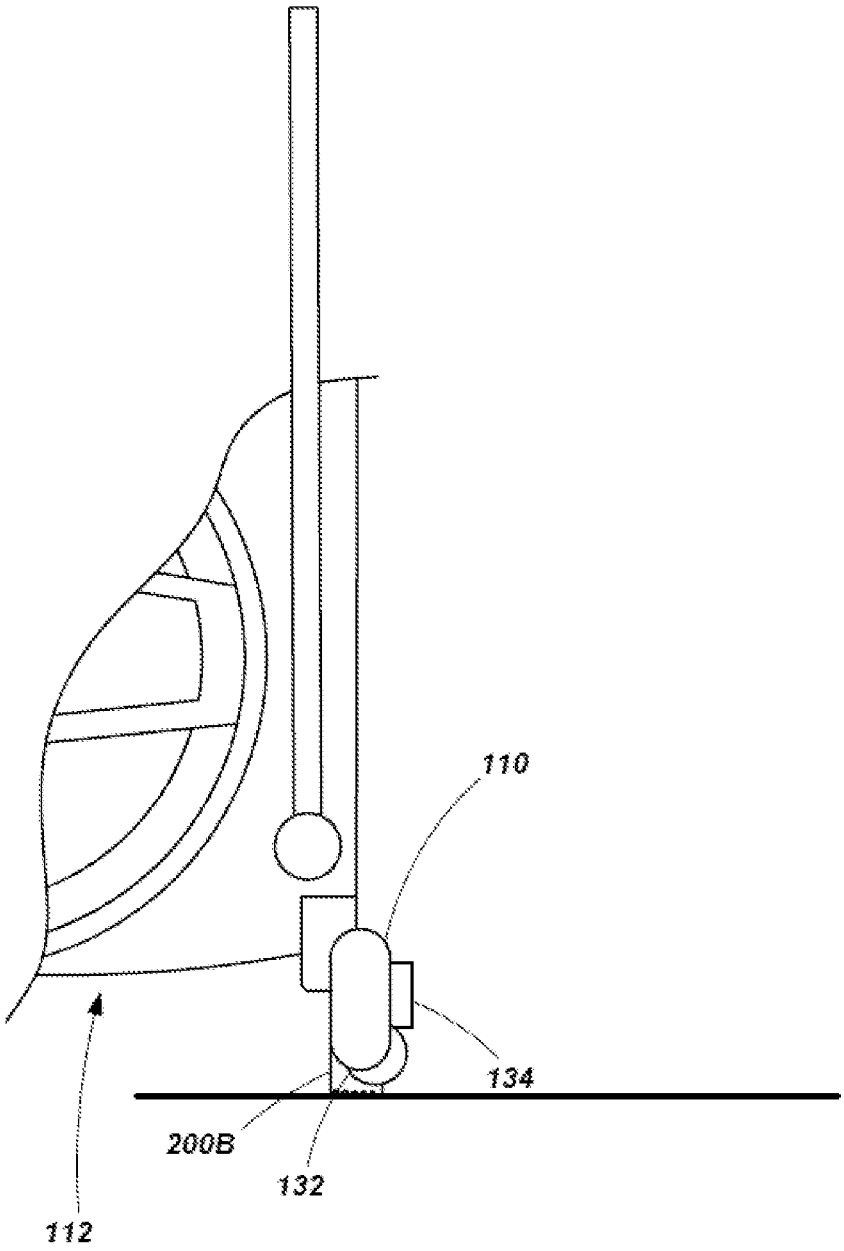

Referring to FIGS. 13A-13D, operation of the rotational assist mechanism may be seen. As seen in FIG. 13A, when it is desired to rotate the elliptical machine 250 into an upright position (e.g., after it has been folded such as shown in FIG. 12), the lever arm 272 may be released from the catch 276 or locking mechanism such that the biasing member rotates the free end 274 into engagement with the ground or floor and applies a biasing force against the ground. The biasing force is continually applied against the force, creating a torque or a moment about the pivot point 278 to provide assistance to a user as they lift the front end of the elliptical machine 250 and rotate the elliptical machine 250 to an upright position as shown in FIG. 13B (where the elliptical machine 250 transitioning) and in FIG. 13C (where the elliptical machine is upright—see also FIG. 8). Once in the upright position, a user may choose to leave the lever arm 272 in biasing engagement with the floor (for example to provide additional stability to the elliptical machine while in the upright position) or they may rotate the lever arm back into a locked position such as shown in FIG. 13D such that the elliptical machine exhibits a reduced footprint.

When a user desires to rotate the elliptical machine back from an upright position, the user may cause the lever arm 272 to engage the ground (as shown in FIG. 13C) and allow the rotational assist mechanism to provide a biasing force to make it easier to lower the elliptical machine back to a position such as shown in FIGS. 12 and 13A.

INDUSTRIAL APPLICABILITY

Elliptical exercise machines, while popular for residential use, inherently take up a substantial amount of space in a user's home or apartment. For example, in one embodiment, an elliptical machine may be approximately 24 to 30 inches in width, approximately 76 to 84 inches in length and approximately 62 to 70 inches in height. Some users may not desire to permanently dedicate so much space in their residence to an exercise machine. The elliptical machines described herein provide the ability to place the machine in a collapsed position or state when not in use so that the elliptical machine may be stored or more easily maneuvered and transported.

One of the advantages of the described embodiments above is that the elliptical machine is configured in two assemblies, which may be referred to as an upper assembly and a lower assembly, wherein the upper assembly pivots and folds down on to (or adjacent to) the lower assembly without the need to disassemble or otherwise any of the operational components such as the foot supports or the reciprocating arms. In various prior art devices, in order to collapse or fold into a storage condition. For example, some prior art devices required a "break-away" joint in the foot supports or the reciprocating arms, such that a user would have to disassemble such joints in order to facilitate the folding or collapsing, and then reassemble such joints when the elliptical machine was unfolded or expanded and prior to using the exercise machine again. Moreover, the present design eliminates the possibility of someone trying to use an elliptical machine prior to reassembly of such components, which could possibly result in damage to the machine or injury to the user.

Similarly, folding or collapsing of the assemblies in the elliptical machines described herein does not require the adjustment of any operative components such as the foot supports or reciprocating arms. For example, as previously noted, PCT Patent Application Publication No. WO2008138124 describes a machine wherein the reciprocating arms require adjustment between the operative condition and the stored condition. The present invention does not require any adjustment of the reciprocating arms or the foot supports to in transitioning from the operable condition to the stored condition. Rather, the components of the first assembly all maintain their operational relationship to one another and all the components of the second assembly maintain their operational relationship to one another before and after the folding or unfolding of the elliptical machine. Such a configuration enables very simple folding and deployment of the elliptical machine by a user since they don't have to adjust any critical components (e.g., foot supports or reciprocating arms) and ensures that the elliptical machine is in a ready immediately after unfolding.

The ability to fold or collapse the elliptical machine further provides advantages in moving or transporting the machine when not in use. Besides taking up less space when in a folded state, the elliptical machine is much easier to handle or transport when in the folder state since it is more compact and its center of gravity is more amenable to lifting and maneuvering making it less likely to tip or fall. Furthermore, the ability to fold and unfold the elliptical machine makes it easier to ship or transport in a small package while not requiring assembly after shipping or purchase by the end user.

When rotated into an upright position such that the elliptical machine is supported by the support structures (such as shown in FIG. 8), the elliptical machine takes up considerable less floor space. Stated another way, the elliptical machine may be stored in such a manner as to reduce its footprint. In embodiments where the support structures are selectively positionable, or adjustable, a wider base (defined by the support structures) may be provided for increased stability of the elliptical machine while still reducing the size of its footprint (i.e., comparing the footprint of the elliptical machine while in an upright, stored position with that of an operating state or position).

The configuration of support structures with anti-slip features additional help to stabilize the elliptical machine while it is in an upright, stored position. In embodiments where removable covers may be placed on the support structures, such provides a user the ability to choose the type of engagement surface depending, for example, on the type of floor on which the elliptical machine will be stored. In one embodiment, a more rigid support structure may be used when the floor or support surface is, for example, carpet or an exercise mat of some sort. On the other hand, a relatively softer cover may be used if the support surface is a fairly hard and slick surface such as wood or tile.

An elliptical machine having a rear cross member with the various components described herein (such as a foot, wheel and support structure) also provides for a stable structure in both operational and storage positions, while also providing flexibility in being able to maneuver the elliptical machine from one location to another.

An elliptical machine having a folding assist mechanism provides assistance to a user to fold and unfold the various assemblies of the elliptical machine with relative ease. Additionally, the reduction of the possibility of one assembly falling and slamming into the other assembly improves the safety of the device and decreases the risk of damage to the device during the folding and unfolding operations.

An elliptical machine having a rotational assist mechanism also provide assistance to a user in rotating the elliptical machine to or from an upright storage position such that smaller users that might not otherwise have adequate strength to perform such an operation may do so. Furthermore, the rotational assist mechanism may improve the safety of rotating the elliptical machine into and out of an upright storage position by reducing the likelihood of the elliptical machine being dropped inadvertently.

What is claimed is:

1. An elliptical exercise machine comprising:

a first assembly including a first frame member;

a second assembly including a second frame member coupled with the first frame member;

a rotational assist mechanism associated with the first assembly, the rotational assist mechanism including at least one lever arm configured to engage a ground on which the elliptical exercise machine rests and apply a moment to the first assembly when at least a portion of the elliptical exercise machine is being lifted.

2. The elliptical exercise machine of claim 1, further comprising a plurality of support structures configured to support the elliptical machine in an upright storage position wherein the first frame member extends in a substantially vertical direction.

3. The elliptical exercise machine of claim 2, wherein the first assembly includes a rear cross member coupled with the first frame member, wherein the plurality of supporting structures includes one or more support structures coupled with the rear cross member.

4. The elliptical exercise machine of claim 3, wherein the first assembly includes a front cross member coupled with the first frame member and a handle coupled with the front cross member.

5. The elliptical exercise machine of claim 1, wherein the first frame member is pivotally coupled with the second frame member such that the second assembly is pivotally displaceable relative to the first assembly from a first position to a second position.

6. The elliptical exercise machine of claim 5, further comprising a folding assist mechanism coupled between the first assembly and the second assembly, the folding assist mechanism being configured to provide resistance to the second assembly as the second assembly is displaced from the first position to the second position.

7. The elliptical exercise machine of claim 6, wherein the folding assist mechanism comprises at least one of a biasing member and a damping member.

8. The elliptical exercise machine of claim 1, further comprising a locking mechanism associated with the first assembly, wherein the locking mechanism is configured to selectively engage the rotational assist mechanism and prevent the at least one lever arm from engaging the ground.

9. The elliptical exercise machine of claim 1, further comprising a rotational resistance mechanism associated with the first frame member;

at least one foot support member pivotally coupled to a portion of the rotational resistance mechanism; and at least one reciprocating arm pivotally coupled with the second frame member;

wherein the at least one lever arm includes a first lever arm positioned on a first side of the rotational resistance mechanism and a second lever arm positioned on a second, opposing side of the rotational resistance mechanism.

10. An elliptical exercise machine comprising:

a first assembly including a first frame member;

a second assembly pivotally coupled with the first assembly, the second assembly including a second frame member;

at least one folding assist mechanism coupled between the first assembly and the second assembly, the at least one folding assist mechanism being configured to provide resistance to the second assembly as the second assembly rotates relative to the first assembly between a first, operating position and a second, folded position;

a rotational assist mechanism associated with the first assembly, the rotational assist mechanism including at least one lever arm configured to engage a ground and apply a moment to the elliptical exercise machine when at least a portion of the elliptical exercise machine is being lifted.

11. The elliptical exercise machine of claim 10, wherein the at least one folding assist mechanism includes a damping mechanism.

12. The elliptical exercise machine of claim 10, further comprising:

a rotational resistance mechanism associated with the first frame member;

at least one foot support member pivotally coupled to a portion of the rotational resistance mechanism; and at least one reciprocating arm pivotally coupled with the second frame member;

wherein the at least one lever arm includes a first lever arm positioned on a first side of the resistance mechanism and a second lever arm positioned on a second, opposing side of the resistance mechanism; and wherein the at least one folding assist mechanism has a first end pivotally coupled with the first frame member and a second end pivotally coupled with the second frame member.

13. The elliptical exercise machine of claim 10, wherein the folding assist mechanism includes at least one of a biasing member and a damping member.

14. A method of operating an elliptical exercise machine, comprising:

biasing a front portion of an elliptical exercise machine with a rotational assist mechanism that is incorporated into a rear portion of the elliptical exercise machine; and lifting a front portion of the elliptical exercise machine into an upright position while the rotational assist mechanism applies a force that provides a torque about a pivot point of the rear portion such that the provided torque assists with lifting the front portion of the elliptical exercise machine.

15. The method of claim 14, wherein the rotational assist mechanism comprises a lever arm connected to the pivot point.

16. The method of claim 15, wherein biasing the front portion comprises releasing the lever arm from a locking mechanism so that the lever arm rotates into an engagement with a floor to provide the force.

17. The method of claim 15, further comprising rotating the lever arm back into a locked position after the elliptical exercise machine is in the upright position.

18. The method of claim 14, further comprising lowering the front portion of the elliptical exercise machine while the rotational assist mechanism applies the force.

19. The method of claim 18, wherein the rotational assist mechanism comprises a lever arm connected to the pivot point.

20. The method of claim 14, further comprising providing stability to the elliptical exercise machine in the upright position by leaving the rotational assist mechanism engaged.

* * * * *